US009323282B2

(12) United States Patent
Min et al.

(10) Patent No.: US 9,323,282 B2
(45) Date of Patent: Apr. 26, 2016

(54) APPARATUS FOR REDUCING CLUTCH PEDAL EFFORT

(71) Applicants: Hyundai Motor Company, Seoul (KR); Kia Motors Corp., Seoul (KR); Dong Hee Industrial Co., Ltd., Ulsan (KR)

(72) Inventors: Jeong Seon Min, Gwangju (KR); Young Seok Song, Busan (KR)

(73) Assignees: Hyundai Motor Company, Seoul (KR); Kia Motors Corp., Seoul (KR); Dong Hee Industrial Co., Ltd., Ulsan (KR)

( * ) Notice: Subject to any disclaimer, the term of this patent is extended or adjusted under 35 U.S.C. 154(b) by 0 days.

(21) Appl. No.: 14/470,527

(22) Filed: Aug. 27, 2014

(65) Prior Publication Data

US 2015/0153761 A1 Jun. 4, 2015

(30) Foreign Application Priority Data

Dec. 3, 2013 (KR) ..... 10-2013-0149552

(51) Int. Cl.

| | |
|---|---|
| ***G05G 1/30*** | (2008.04) |
| ***G05G 1/44*** | (2008.04) |
| ***G05G 5/03*** | (2008.04) |

(52) U.S. Cl.

CPC .. *G05G 1/44* (2013.01); *G05G 5/03* (2013.01); *Y10T 74/20528* (2015.01)

(58) Field of Classification Search

CPC ..... G05G 7/04; G05G 1/30; G05G 1/46; G05G 1/44; G05G 5/03

USPC ..... 74/512

See application file for complete search history.

(56) References Cited

U.S. PATENT DOCUMENTS

| | | | | | |
|---|---|---|---|---|---|
| 4,800,774 | A * | 1/1989 | Hagiwara | ..... | G05G 7/04 192/111.12 |
| 4,907,468 | A * | 3/1990 | Hagiwara | ..... | G05G 7/04 74/512 |
| 2009/0000418 | A1* | 1/2009 | Kim | ..... | B60K 23/02 74/512 |
| 2015/0143943 | A1* | 5/2015 | Min | ..... | G05G 1/40 74/512 |
| 2015/0153760 | A1* | 6/2015 | Kim | ..... | G05G 1/44 74/512 |
| 2015/0177774 | A1* | 6/2015 | Min | ..... | B60K 23/02 74/560 |

FOREIGN PATENT DOCUMENTS

| | | | | | |
|---|---|---|---|---|---|
| DE | 958885 | C * | 2/1957 | ..... | G05G 7/04 |
| JP | S62-150228 | U | 9/1987 | | |
| JP | H06-011017 | B2 | 2/1994 | | |
| KR | 10-2007-0016554 | A | 2/2007 | | |
| KR | 10-0820241 | B1 | 4/2008 | | |
| KR | 10-0926035 | B1 | 11/2009 | | |
| KR | 10-2011-0046242 | A | 5/2011 | | |
| KR | 10-1241567 | B1 | 3/2013 | | |
| WO | WO 02/067072 | A1 | 8/2002 | | |

* cited by examiner

*Primary Examiner* — Vicky Johnson

(74) *Attorney, Agent, or Firm* — Morgan, Lewis & Bockius LLP

(57) ABSTRACT

An apparatus for reducing clutch pedal effort may include a spring bracket coupled with a hinge pipe, a switching lever rotatably coupled with the hinge pipe so as to come into contact with a pedal arm during a rotation of the switching lever, thus intensifying a forward rotation of the pedal arm, and a reaction providing unit combined with a pedal member and the switching lever at opposite ends. The reaction providing unit may be operated in such a way that, when the switching lever is not rotated, the reaction providing unit sets an initial position of the switching lever by restricting a movement of the switching lever using accumulated elasticity, and when the switching lever is rotated, the reaction providing unit provides a reaction force to the pedal arm so as to cause the switching lever to come into contact with the pedal arm.

7 Claims, 10 Drawing Sheets

APPARATUS FOR REDUCING CLUTCH PEDAL EFFORT

CROSS REFERENCE TO RELATED APPLICATION

The present application claims priority of Korean Patent Application Number 10-2013-0149552 filed on Dec. 3, 2013, the entire contents of which application are incorporated herein for all purposes by this reference.

BACKGROUND OF INVENTION

1. Field of Invention

The present invention relates, in general, to an apparatus for reducing clutch pedal effort and, more particularly, to a technology relating to an apparatus for reducing clutch pedal effort, which can reduce pedal effort that may be sensed by a driver when working a clutch pedal, and which can be efficiently used in a vehicle that is equipped with a high horsepower engine capable of generating high output power, without breaking parts of the vehicle.

2. Description of Related Art

In a manual transmission car, to realize efficient transmission of engine power to a gearbox when a clutch disc and a flywheel are coupled together such that power transmission can be realized, it is required to avoid slip between the clutch disc and the flywheel.

In recent years, as the performance of cars has gradually improved, high horsepower engines capable of generating high output power are generally used in such vehicles. When a high horsepower engine is used in a car, it is required to increase the spring force of a diaphragm compared to that of a typical diaphragm in an effort to realize reliable coupling of the clutch disc to the flywheel. As a technology for increasing the spring force of the diaphragm, the diameter of a turnover spring may be increased.

However, when increasing the spring force of the turnover spring, the pedal effort of the clutch pedal is also increased and this causes a problem in that a driver easily feels fatigued while working the clutch pedal. Particularly, when increasing the diameter of the turnover spring in an effort to increase the spring force, the load concentrated on the turnover spring is also increased, so parts, such as a spring bushing, etc., used to connect the turnover spring to a pedal member may be easily broken.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Accordingly, the present invention has been made keeping in mind the above problems occurring in the related art and/or other problems, and the present invention is intended to provide an apparatus for reducing clutch pedal effort, which can reduce pedal effort that may be sensed by a driver when working a clutch pedal, and which can be efficiently used in a vehicle that is equipped with a high horsepower engine capable of generating high output power, without breaking parts of the vehicle.

According to various aspects of the present invention, there is provided an apparatus for reducing clutch pedal effort, including: a spring bracket that is coupled with a hinge pipe, through which a pedal hinge passes, such that the spring bracket protrudes forward; a switching lever that is rotatably coupled with the hinge pipe such that, during a forward rotation of a pedal arm, the switching lever is rotated exclusively when the switching lever comes into contact with the spring bracket, and the switching lever comes into contact with the pedal arm during a rotation of the switching lever, thereby intensifying the forward rotation of the pedal arm; and a reaction providing unit that is placed at a location above the pedal hinge, with a first end thereof combined with an upper surface of a pedal member and a second end thereof combined with the switching lever, wherein the reaction providing unit is operated in such a way that, when the switching lever is not rotated, the reaction providing unit sets an initial position of the switching lever by restricting a movement of the switching lever using accumulated elasticity thereof, and when the switching lever is rotated, the reaction providing unit provides a reaction force to the pedal arm so as to cause the switching lever to come into contact with the pedal arm.

The apparatus may further include: a turnover spring that is held by the spring bracket, with opposite ends of the turnover spring held by opposite side surfaces of the pedal member, respectively, such that, during the forward rotation of the pedal arm, the turnover spring provides elasticity in cooperation with the reaction providing unit so as to intensify the forward rotation of the pedal arm.

To allow the reaction providing unit to set the initial position of the switching lever in a state in which the pedal arm is not worked, a joint at which the switching lever is combined with the reaction providing unit may be placed ahead of a reference line that passes both a center of the pedal hinge and a joint at which the pedal member is combined with the reaction providing unit.

The switching lever may include: a rotating center part, with a cylindrical flange formed in the rotating center part and fitted over the hinge pipe, and with locking protrusions protruding sideward from a portion above the cylindrical flange and combined with a lower end of the reaction providing unit; a front rod unit that is formed by extending from the rotating center part to a side, with a front contact protrusion protruding on a surface of the front rod unit so as to come into contact with the spring bracket; and a rear rod unit that is formed by extending from the rotating center part to an opposite side, with a rear contact protrusion protruding on a surface of the rear rod unit so as to come into contact with a rear surface of the pedal arm.

The front rod unit may be provided with a guide protrusion that protrudes in a direction opposite to the front contact protrusion, and the pedal member may be provided with a guide slot that is formed along a radius of rotation of the switching lever so as to guide a movement of the guide protrusion during the rotation of the switching lever.

A front bushing and a rear bushing may be coupled with the front contact protrusion and the rear contact protrusion, respectively, and function to prevent generation of noise and to absorb shock when the front and rear contact protrusions come into contact with the spring bracket and the pedal arm, respectively.

The reaction providing unit may include: a rotating shaft rotatably installed by passing through opposite side surfaces of the pedal member; a shaft holder, with a surface contact groove formed on a first end of the shaft holder so as to be supported by coming into surface contact with an outer circumferential surface of the rotating shaft, and with a guide pin extending from a second end of the shaft holder; a lever holder, with a fork part formed on a first end of the lever holder and having a locking groove so as to be engaged with the locking protrusions of the switching lever, and with a holder rod extending from a second end of the lever holder and having a pin insert hole so as to receive the guide pin of the shaft holder therein; a nut engaged with the holder rod; and a compression spring fitted over the holder rod in a state in which opposite ends of the compression spring are abutted by the shaft holder and by the nut, respectively.

External threads may be formed around an outer circumferential surface of the holder rod in an axial direction of the holder rod, and the nut may be engaged with the external threads of the holder rod such that the nut adjusts elasticity of the compression spring by moving along the axial direction of the holder rod.

As described above, the present invention is advantageous in that, during a rotation of the pedal arm worked by a driver, the clutch pedal effort that may be sensed by the driver can be greatly reduced, so the present invention can efficiently attenuate fatigue of the driver while working the pedal arm. Further, during an initial state in which the pedal arm is not worked, the present invention can induce complete restoring of the pedal arm to an original position thereof, thereby realizing reliable coupling of a clutch disc to a flywheel and being efficiently used in a vehicle that is equipped with a high horsepower engine capable of generating high output power, without breaking parts of the vehicle.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

The above and other objects, features and other advantages of the present invention will be more clearly understood from the following detailed description when taken in conjunction with the accompanying drawings, in which:

FIGS. 8 and 9 are views showing the operation of the clutch pedal effort reducing apparatus according to the present invention, in which FIG. 8 shows an initial working stage of the pedal arm and FIG. 9 shows a state in which a driver works the pedal arm with a full stroke.

DETAILED DESCRIPTION

Figure 1:
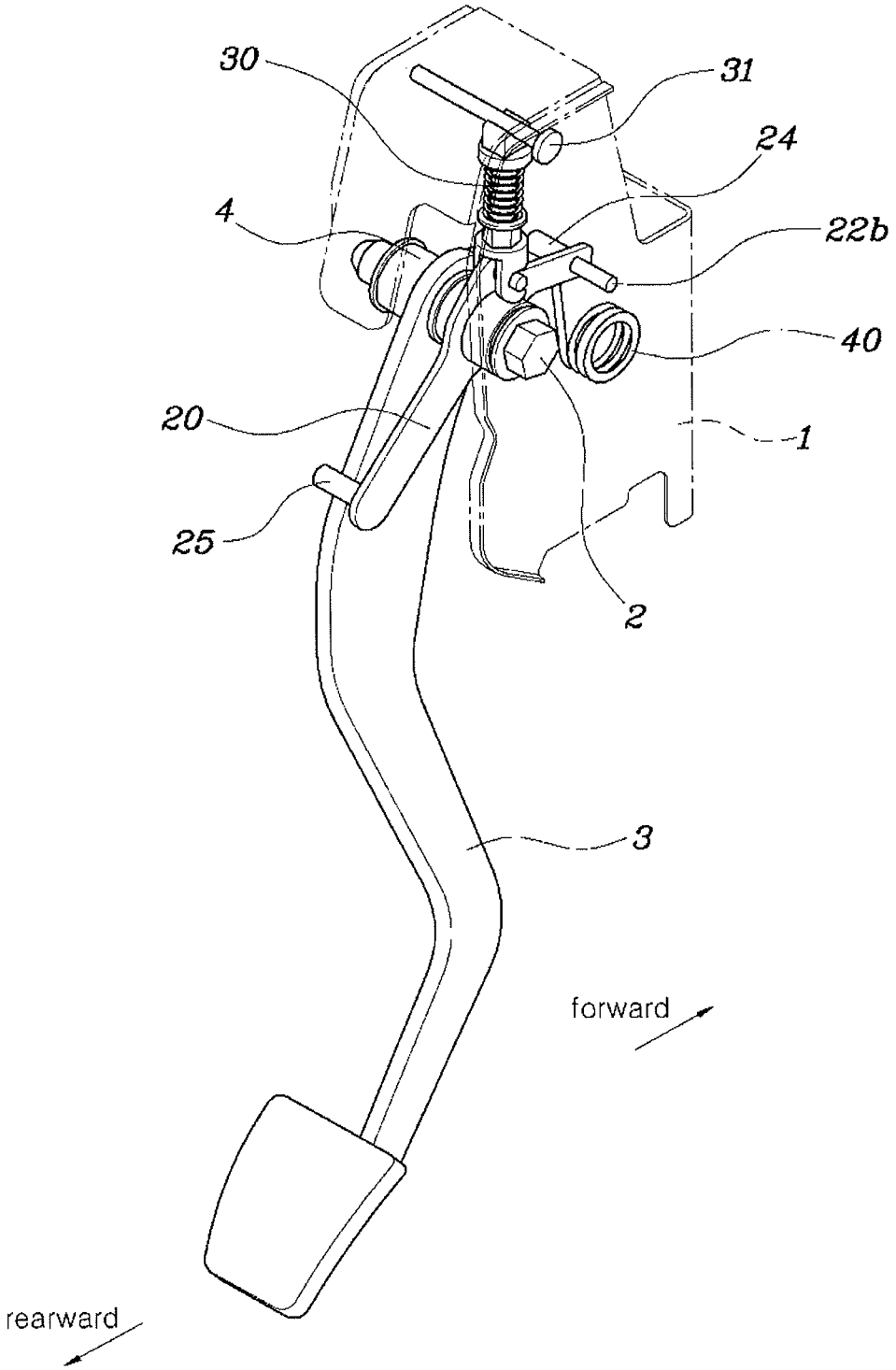
FIG. 1 is a perspective view of a clutch pedal provided with a pedal effort reducing apparatus according to the present invention.
Figure 2:
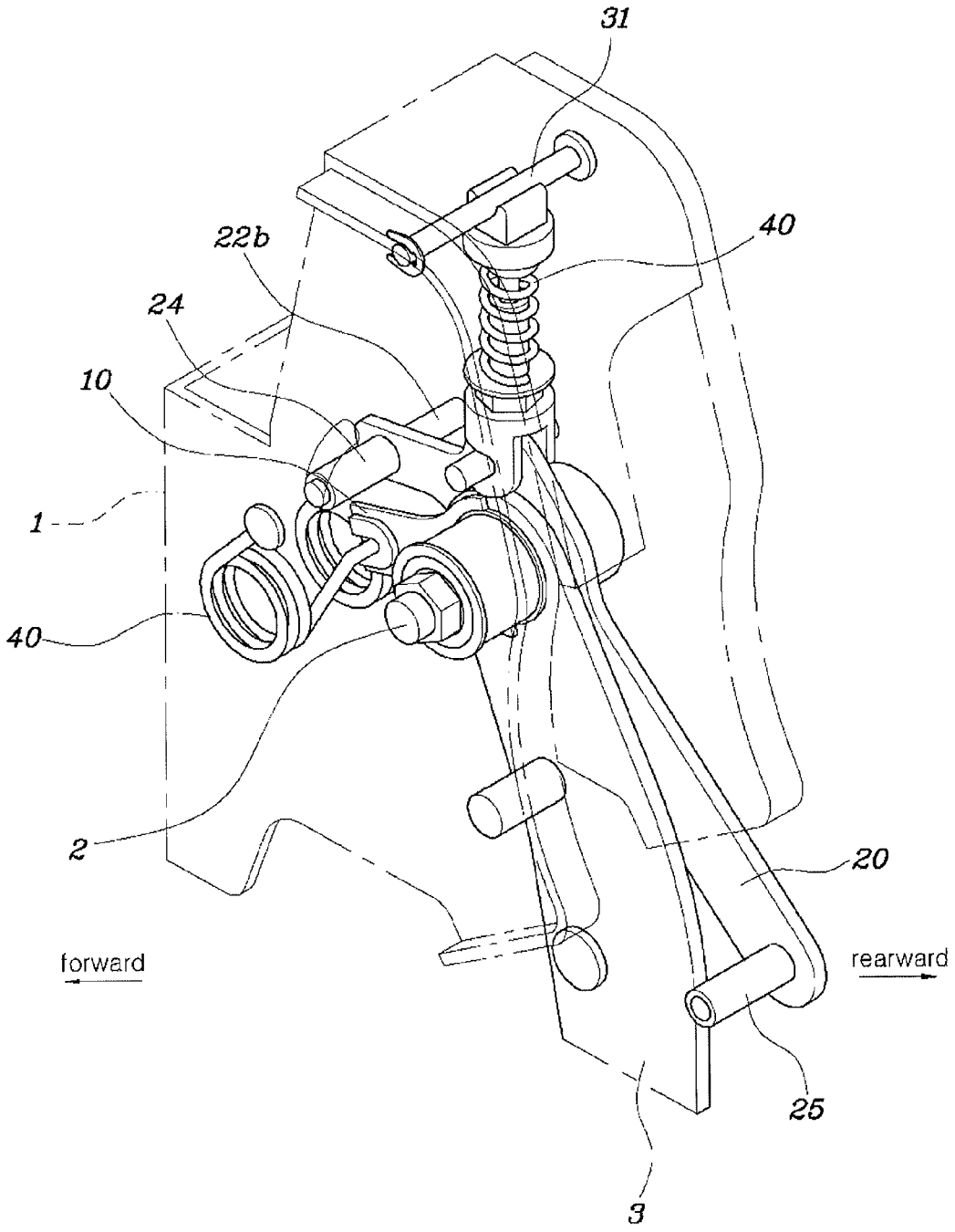
FIG. 2 is an enlarged view of FIG. 1.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

As shown in FIGS. 1 to 9, the apparatus for reducing clutch pedal effort according to the present invention includes: a pedal member 1 that is mounted to a dash panel provided in front of a lower part of a driver's seat; a pedal arm 3 that is rotatably mounted to the pedal member 1 with the intervention of a pedal hinge 2 between the pedal arm 3 and the pedal member 1 such that the pedal arm 3 can be rotated forward and rearward; a spring bracket 10 that is assembled with a hinge pipe 4, through which the pedal hinge 2 passes, such that the spring bracket 10 protrudes forward; a switching lever 20 that is rotatably assembled with the hinge pipe 4 such that, during a forward rotation of the pedal arm 3, the switching lever 20 is rotated exclusively when the switching lever 20 comes into contact with the spring bracket 10, and the switching lever 20 comes into contact with the pedal arm 3 during a rotation of the switching lever 20, thereby intensifying the forward rotation of the pedal arm 3; and a reaction providing unit 30 that is placed at a location above the pedal hinge 2, with a first end thereof combined with the upper surface of the pedal member 1 and a second end thereof combined with the switching lever 20, wherein the reaction providing unit 30 is operated in such a way that, when the switching lever 20 is not rotated, the reaction providing unit 30 can set an initial position of the switching lever 20 by restricting the movement of the switching lever 20 using accumulated elasticity thereof, and when the switching lever 20 is rotated, the reaction providing unit 30 can provide a reaction force to the pedal arm 3 so as to cause the switching lever 20 to come into contact with the pedal arm 3.

The apparatus according to the present invention further includes a turnover spring 40 that is held by the spring bracket 10, with opposite ends of the turnover spring 40 held by opposite side surfaces of the pedal member 1, respectively, such that, during the forward rotation of the pedal arm 3, the turnover spring 40 provides elasticity in cooperation with the reaction providing unit 30 so as to intensify the forward rotation of the pedal arm 3.

Here, the hinge pipe 4 is combined with the pedal arm 3 by passing through the upper part of the pedal arm 3, and is installed in the pedal member 1. After placing both the pedal arm 3 and the hinge pipe 4 relative to the pedal member 1, the pedal hinge 2 is installed by passing through opposite side surfaces of both the hinge pipe 4 and the pedal member 1. Here, the upper part of the pedal arm 3 is rotatably mounted to the pedal member 1 with the intervention of the pedal hinge 2 between the pedal arm 3 and the pedal member 1 such that the pedal min 3 can be rotated forward and rearward.

Figure 3:
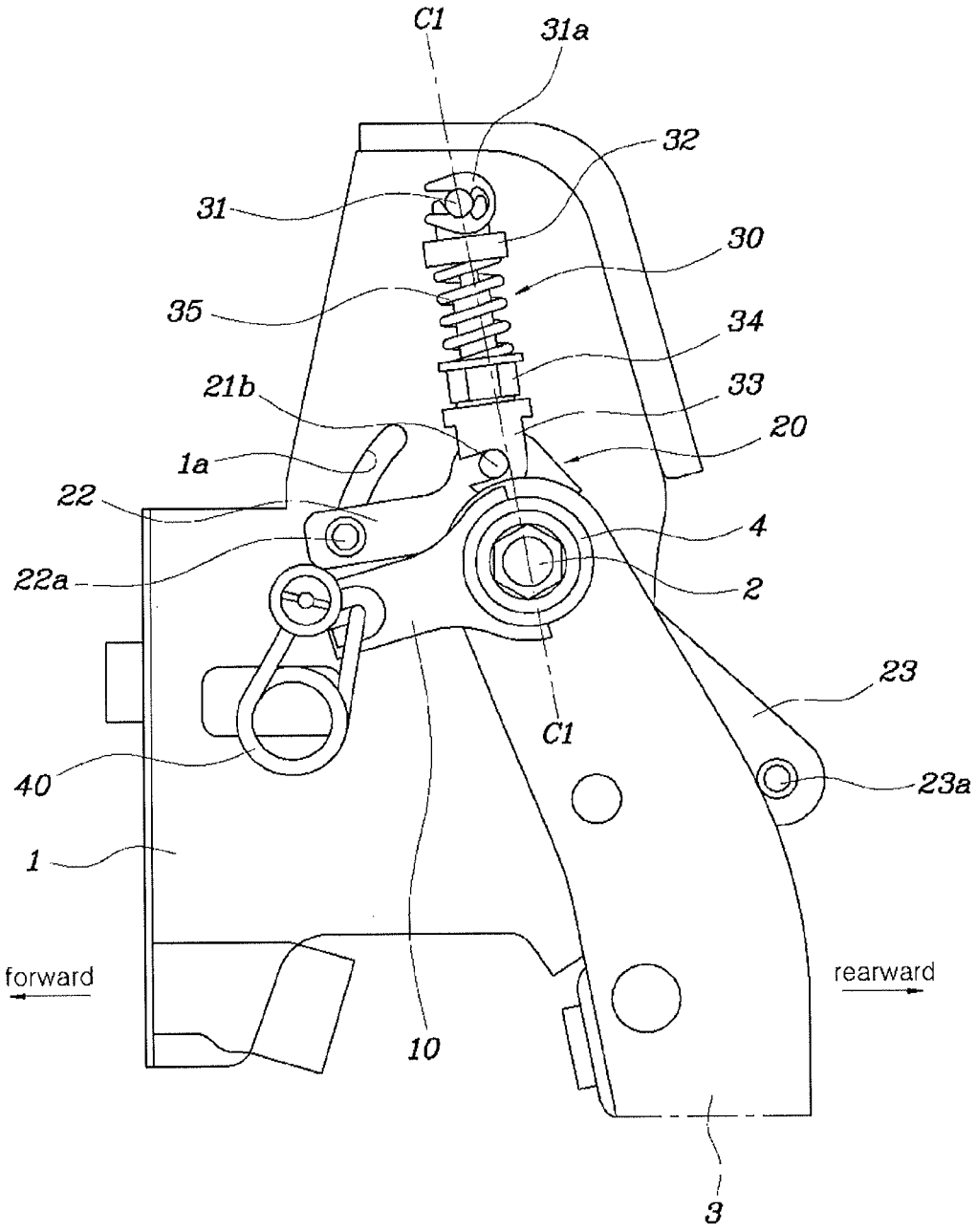
FIG. 3 is a side view of FIG. 1, which shows an initial state of the apparatus before a diver works a pedal arm.
Figure 4:
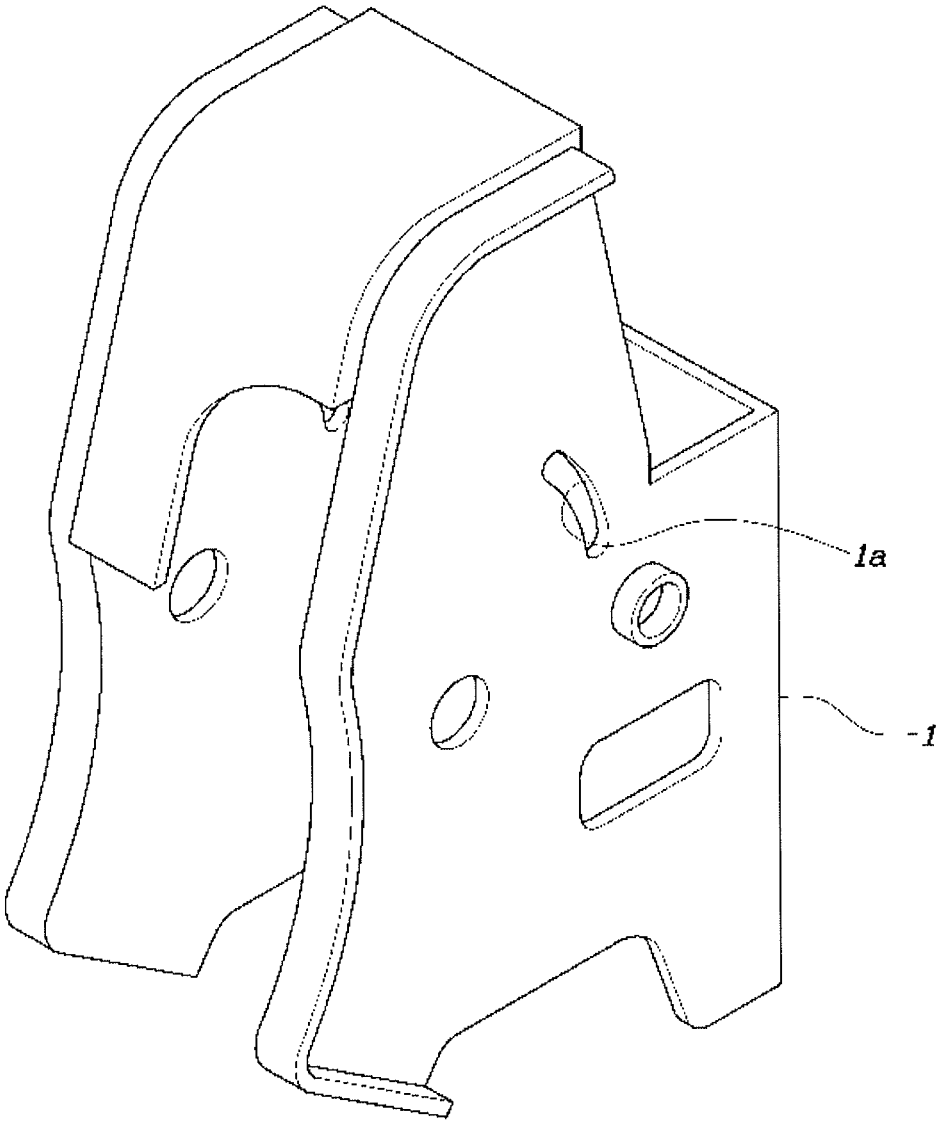
FIG. 4 is a perspective view showing a pedal member provided with a guide slot according to the present invention.
Figure 5A:
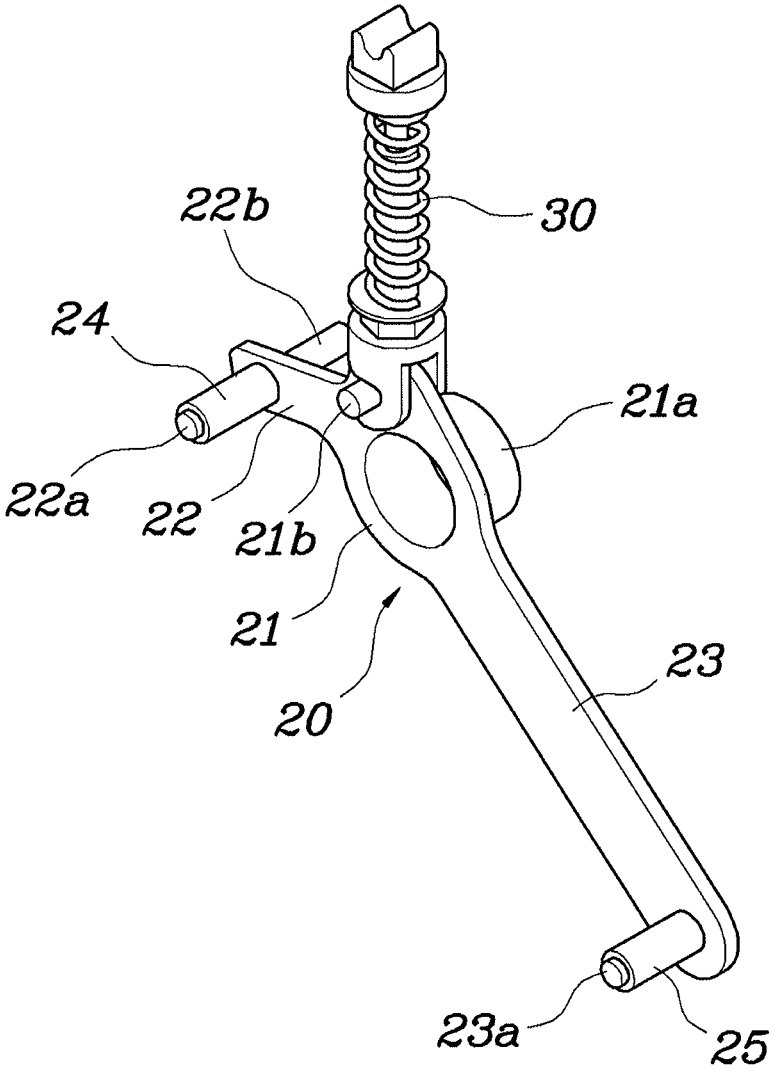
FIGS. 5A and 5B are perspective views showing a switching lever according to the present invention.
Figure 5B:
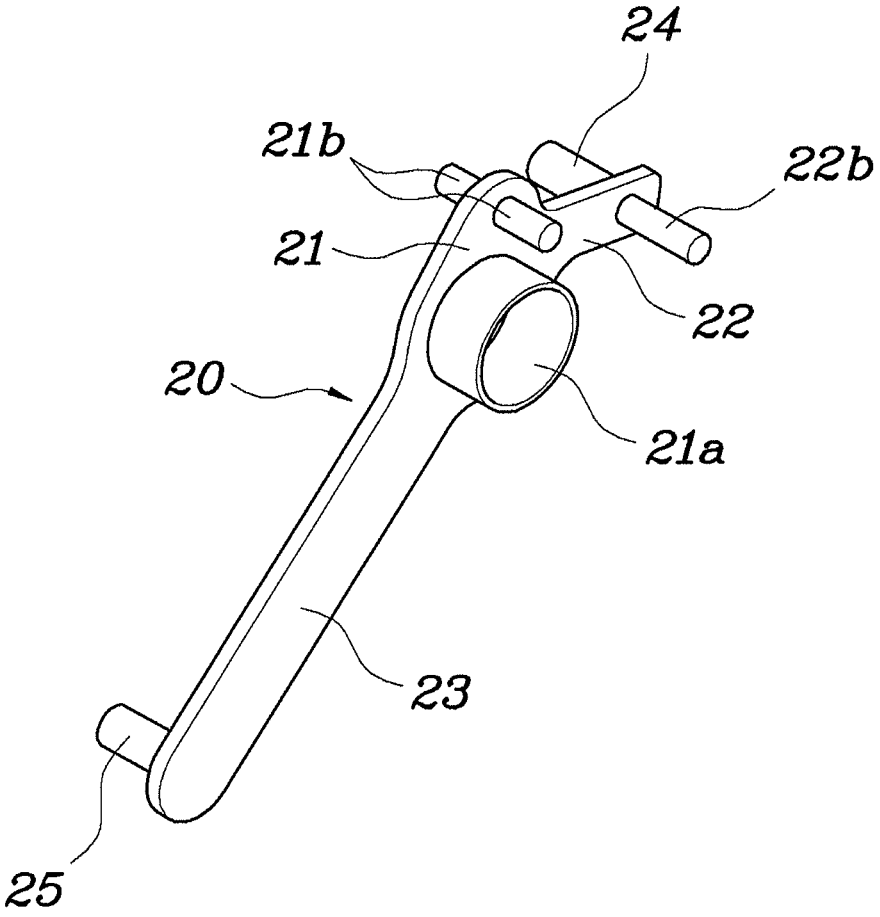
Figure 6:
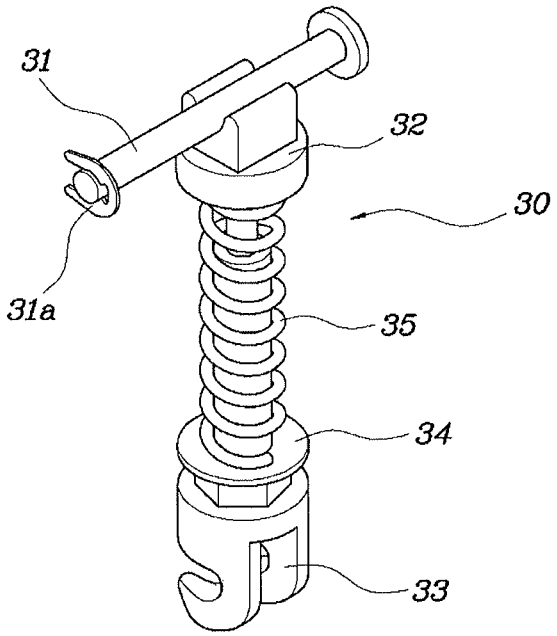
FIGS. 6 and 7 are views showing a reaction providing unit according to the present invention.
Figure 7:
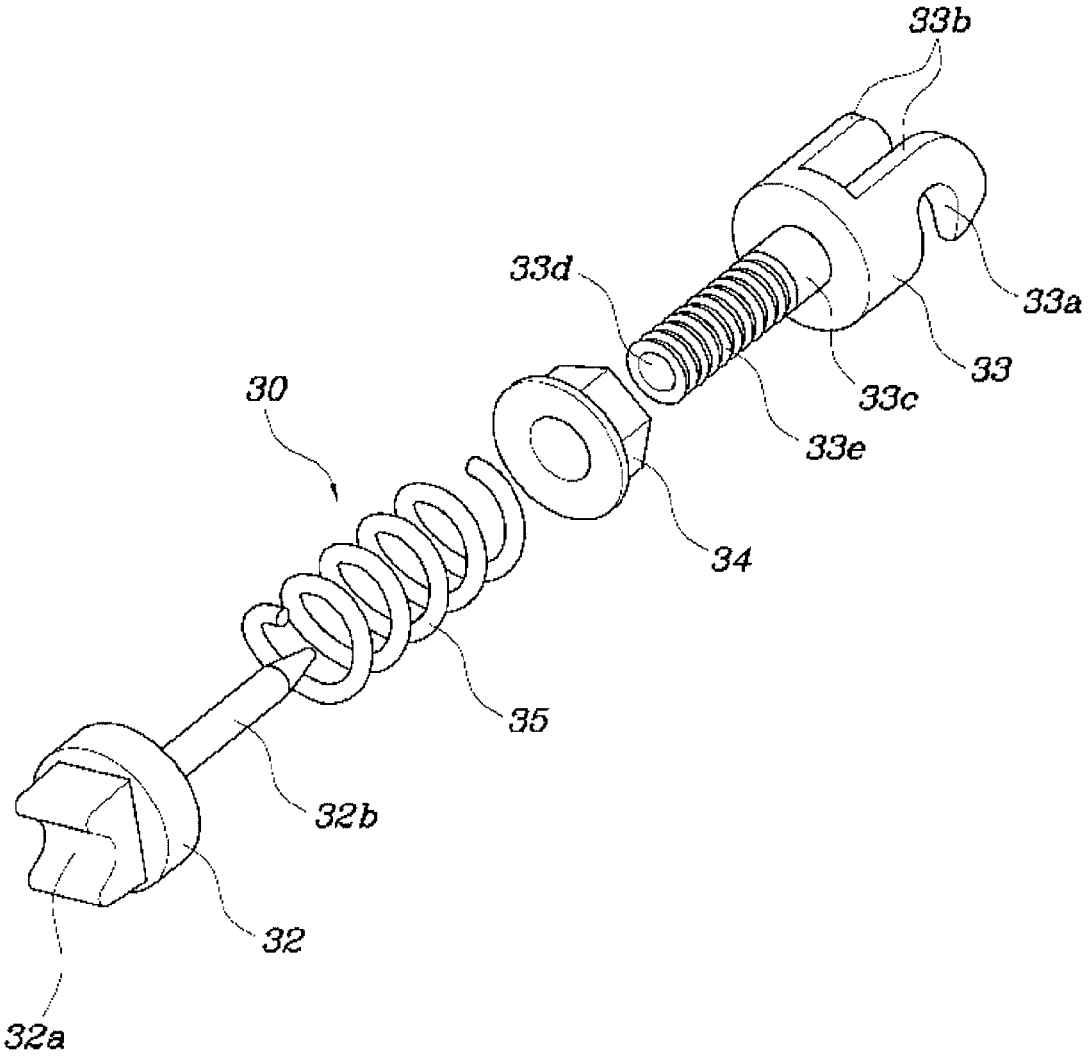

As shown in FIG. 3, the apparatus of the present invention is configured such that, based on a reference state in which the pedal arm 3 is not worked, that is, the switching lever 20 is not rotated, the joint at which the switching lever 20 is combined with the lower end of the reaction providing unit 30 is placed ahead of a reference line C1 that is a line passing both the center of the pedal hinge 2 and the joint at which the pedal member 1 is combined with the upper end of the reaction providing unit 30. Due to the above-mentioned configuration or the like, the reaction providing unit 30 can set an initial position of the switching lever 20 by restricting the movement of the switching lever 20 using accumulated elasticity thereof.

Further, the switching lever 20 according to the present invention includes: a rotating center part 21, with a cylindrical flange 21*a* formed in the rotating center part 21 and fitted over the hinge pipe 4, and with locking protrusions 21*b* protruding sideward from a portion above the cylindrical flange 21*a* and combined with the lower end of the reaction providing unit 30; a front rod unit 22 that is formed by extending from the rotating center part 21 to a side, with a front contact protrusion 22*a* protruding on a surface of the front rod unit 22 so as to come into contact with the spring bracket 10; and a rear rod unit 23 that is formed by extending from the rotating center part 21 to an opposite side, with a rear contact protrusion 23*a* protruding on a surface of the rear rod unit 23 so as to come into contact with the rear surface of the pedal arm 3.

Further, the front rod unit 22 is provided with a guide protrusion 22*b* that protrudes in a direction opposite to the front contact protrusion 22*a*, and the pedal member 1 is provided with a guide slot 1*a* that is formed along a radius of rotation of the switching lever 20 so as to guide a movement of the guide protrusion 22*b* during a rotation of the switching lever 20.

Further, a front bushing 24 is fitted over the front contact protrusion 22*a*. The front bushing 24 functions to prevent generation of noise and to absorb shock when the front contact protrusion 22*a* comes into contact with the spring bracket 10 during a rotation of the switching lever 20. Further, a rear bushing 25 is fitted over the rear contact protrusion 23*a*, and functions to prevent generation of noise and to absorb shock when the rear contact protrusion 23*a* comes into contact with the pedal arm 3.

Here, the front bushing 24 and the rear bushing 25 may be made of rubber, plastic or synthetic resin, although the materials of the bushings 24 and 25 are not limited thereto.

Further, the reaction providing unit 30 according to the present invention includes: a rotating shaft 31 rotatably installed by passing through opposite side surfaces of the pedal member 1; a shaft holder 32, with a surface contact groove 32*a* formed on a first end of the shaft holder 32 so as to be supported by coming into surface contact with the outer circumferential surface of the rotating shaft 31, and with a guide pin 32*b* axially extending from a second end of the shaft holder 32; a lever holder 33, with a fork part 33*b* formed on a first end of the lever holder 33 and having a locking groove 33*a* so as to be engaged with the locking protrusions 21*b* of the switching lever 20, and with a holder rod 33*c* axially extending from a second end of the lever holder 33 and having a pin insert hole 33*d* so as to receive the guide pin 32*b* of the shaft holder 32 therein; a nut 34 engaged with the holder rod 33*c*; and a compression spring 35 fitted over the holder rod 33*c* in a state in which opposite ends of the compression spring 35 are stopped or abutted by the shaft holder 32 and by the nut 34, respectively.

Here, a C-shaped clip 31*a* is combined with the first end of the rotating shaft 31 so as to prevent the rotating shaft 31 from being undesirably removed from the pedal member 1.

Further, external threads 33*e* are formed around the outer circumferential surface of the holder rod 33*c* in an axial direction of the holder rod 33*c*, and the nut 34 is engaged with the external threads 33*e* of the holder rod 33*c* such that the nut 34 can adjust the elasticity of the compression spring 35 by moving along the axial direction of the holder rod 33*c*.

Hereinbelow, the operation of the clutch pedal effort reducing apparatus according to the embodiment of the present invention will be described.

FIG. 3 illustrates a state of the apparatus in which the pedal arm 3 has been maximally rotated in a direction toward a driver. In other words, the state of the apparatus shown in FIG. 3 may be a state before the driver works the pedal arm 3 or an initial state of the operation before the driver applies a force to the pedal arm 3.

In this state, accumulated elasticity of the turnover spring 40 is applied to the pedal arm 3 via the spring bracket 10, so the pedal arm 3 is normally biased by a restoring force that intends to rotate the pedal arm 3 rearward, and this allows the pedal arm 3 to be efficiently maintained in a stable state without quaking, and further, induces complete returning of the pedal arm 3 to the original position of the pedal arm 3. Accordingly, the apparatus of the present invention can realize reliable coupling of the clutch disc to the flywheel, so the apparatus is advantageous in that it can be efficiently used in a vehicle that is equipped with a high horsepower engine capable of generating high output power, without breaking parts of the vehicle.

Further, in the initial state shown in FIG. 3, the switching lever 20 is normally biased by the accumulated elasticity of the compression spring 35 constituting the reaction providing unit 30, so the switching lever 20 intends to rotate counterclockwise. Thus, in the above-mentioned initial state, the present invention can restrict a movement of the switching lever 20 using accumulated elasticity of the compression spring 35, thereby setting the initial position of the switching lever 20 and preventing the switching lever 20 from quaking.

Figure 8:
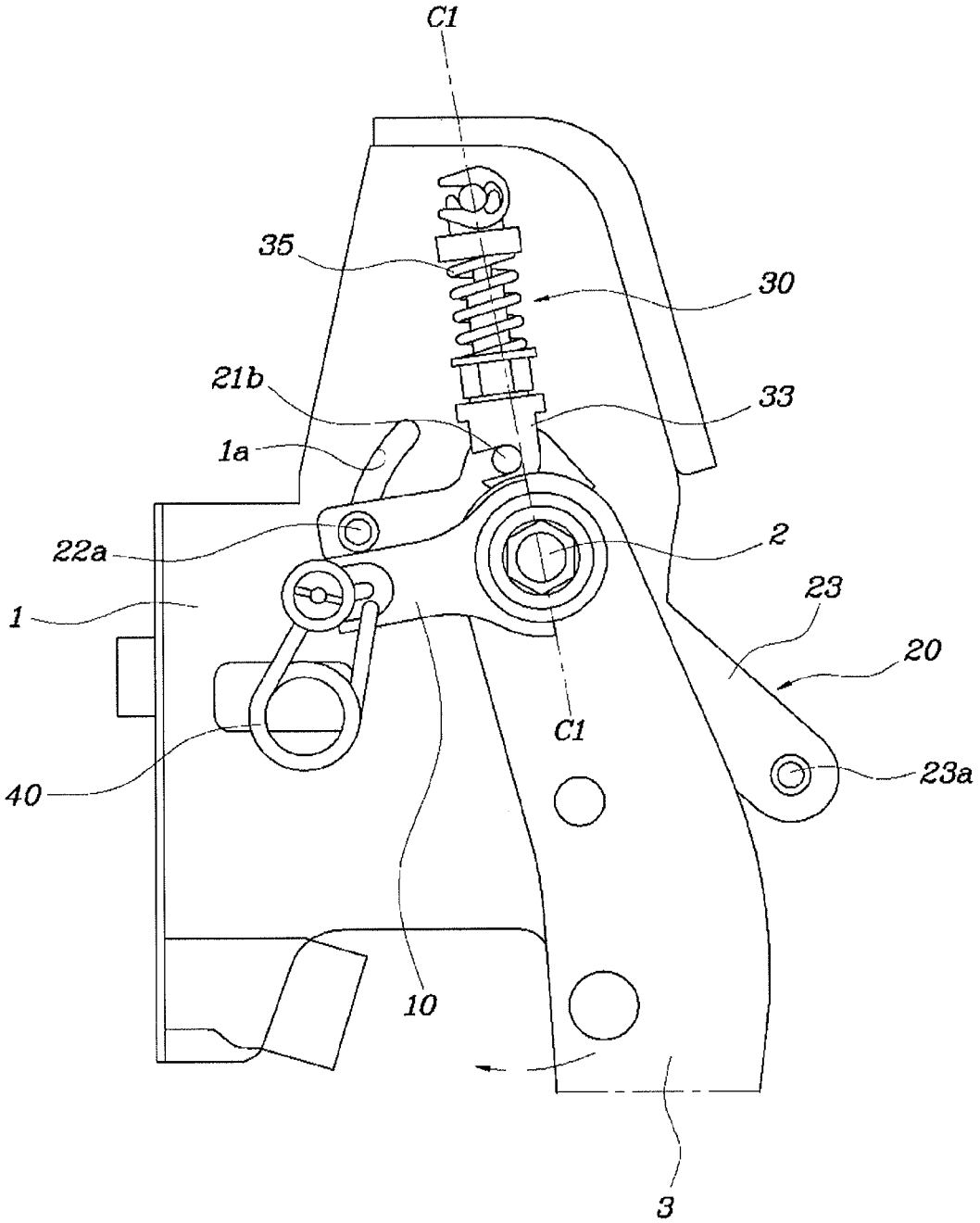

Further, when the driver continuously works the pedal arm 3 so as to gradually rotate the pedal arm 3 forward from the initial state shown in FIG. 3, an initial working stage of the pedal arm 3 shown in FIG. 8 is realized. In the initial working stage of the pedal arm 3, the spring bracket 10 comes into contact with the front bushing 24 that is fitted over the front contact protrusion 22*a* of the switching lever 20.

When the pedal arm 3 is rotated from the initial state of FIG. 3 to the initial working stage of FIG. 8, the reaction force of the turnover spring 40 is applied to a pedal via the pedal arm 3, so the driver senses pedal effort that gradually raises the pedal arm 3, thereby sensing the operational state of the pedal arm 3.

When the pedal arm 3 is further rotated forward from the initial working stage of FIG. 8 by the driver, the switching lever 20 is rotated clockwise along with the pedal arm 3 around the center of the cylindrical flange 21*a*. During the rotation of the switching lever 20, the pedal effort sensed by the driver is gradually increased.

Further, at a time when the locking protrusions 21*b* of the switching lever 20 which are combined with the lower end of the reaction providing unit 30 meet the reference line C1 (line passing both the center of the pedal hinge and the joint at which the pedal member is combined with the upper end of the reaction providing unit) during the continuous rotation of both pedal arm 3 and the switching lever 20, the pedal effort sensed by the driver becomes maximized.

Further, until the locking protrusions 21*b* of the switching lever 20 gradually approach the reference line C1 during the continuous rotation of both the pedal arm 3 and the switching lever 20 from the initial state shown in FIG. 3, the length of the compression spring 35 of the reaction providing unit 30 gradually becomes reduced and elasticity is accumulated in the compression spring 35 due to a movement of the switching lever 20 for raising the lever holder 33.

Figure 9:
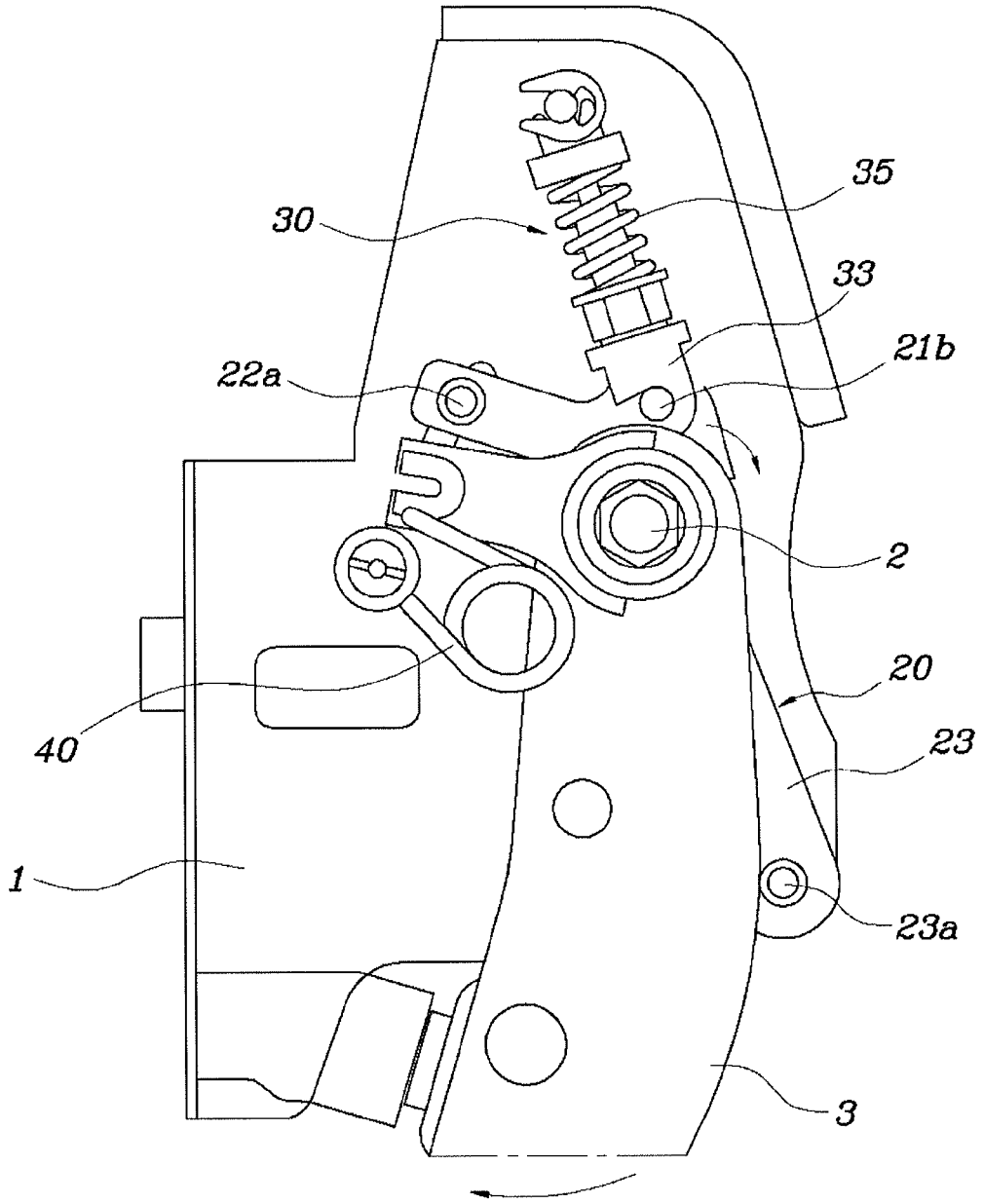

FIG. 9 illustrates a state in which the driver has fully worked the pedal arm 3 so as to rotate the pedal arm 3 forward with a full stroke. In the state shown in FIG. 9, the locking protrusions 21*b* of the switching lever 20 have passed the reference line C1 due to the continuous forward rotation of both the pedal arm 3 and the switching lever 20 from the initial working stage of the pedal arm 3 shown in FIG. 8.

When the procedure of the apparatus approaches the time the locking protrusions 21*b* of the switching lever 20 pass the reference line C1, the rising movement of the lever holder 33 is terminated and the deformation of the compression spring 35 of the reaction providing unit 30 which has resulted in a reduction in the length of the compression spring 35 does not further occur, but the shortened compression spring 35 performs an action of restoring the original length thereof.

Accordingly, the compression spring 35 of the reaction providing unit 30 biases the switching lever 20 clockwise in the drawings using accumulated elasticity thereof, so the rear bushing 25 fitted over the rear contact protrusion 23*a* of the switching lever 20 comes into contact with the rear surface of the pedal arm 3, and pushes the pedal arm 3 forward.

Therefore, during the forward rotation of the pedal arm 3, both the elasticity of the turnover spring 40 and the elasticity of the compression spring 35 are applied to the pedal arm 3, so the forward rotating force of the pedal arm 3 is greatly increased, thereby generating a substantial force capable of reducing the pedal effort and efficiently reducing the pedal effort that may be sensed by the driver. Such a reduction in the pedal effort can efficiently attenuate the fatigue of the driver while working the pedal arm 3.

As described above, the clutch pedal effort reducing apparatus according to the embodiment of the present invention is advantageous in that, during an initial state in which the pedal arm 3 is not worked, elasticity of the turnover spring 40 biases the pedal arm 3 so as to induce complete restoring of the pedal arm 3 to an original position thereof, thereby realizing reliable coupling of the clutch disc to the flywheel. Accordingly, the apparatus of this invention can be efficiently used in a vehicle that is equipped with a high horsepower engine capable of generating high output power, without breaking parts of the vehicle.

Further, after the time the locking protrusions 21*b* of the switching lever 20 combined with the reaction providing unit 30 pass the reference line C1 (line passing both the center of the pedal hinge and the joint at which the pedal member is combined with the upper end of the reaction providing unit) by a driver's full stroke working on the pedal arm 3, the pedal arm 3 is rotated forward by both the elasticity of the turnover spring 40 and the elasticity of the compression spring 35 which are applied to the pedal arm 3. Thus, the forward rotating force of the pedal arm 3 is greatly increased during a forward rotation of the pedal arm 3, thereby generating a substantial force capable of reducing the pedal effort and efficiently reducing the pedal effort that may be sensed by the driver. Such a reduction in the pedal effort can efficiently attenuate the fatigue of the driver while working the pedal arm 3.

For convenience in explanation and accurate definition in the appended claims, the terms "upper" or "lower", "front" or "rear", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An apparatus for reducing clutch pedal effort, comprising:

a spring bracket that is coupled with a hinge pipe, through which a pedal hinge passes, such that the spring bracket protrudes forward;

a switching lever that is rotatably coupled with the hinge pipe such that, during a forward rotation of a pedal arm, the switching lever is rotated exclusively when the switching lever comes into contact with the spring bracket, and the switching lever comes into contact with the pedal arm during a rotation of the switching lever, thereby intensifying the forward rotation of the pedal arm; and a reaction providing unit that is placed at a location above the pedal hinge, with a first end thereof combined with an upper surface of a pedal member and a second end thereof combined with the switching lever, wherein the reaction providing unit is operated in such a way that, when the switching lever is not rotated, the reaction providing unit sets an initial position of the switching lever by restricting a movement of the switching lever using accumulated elasticity thereof, and when the switching lever is rotated, the reaction providing unit provides a reaction force to the pedal arm so as to cause the switching lever to come into contact with the pedal arm, wherein the switching lever comprises:

a rotating center part, with a cylindrical flange formed in the rotating center part and fitted over the hinge pipe, and with locking protrusions protruding sideward from a portion above the cylindrical flange and combined with a lower end of the reaction providing unit;

a front rod unit that is formed by extending from the rotating center part to a side, with a front contact protrusion protruding on a surface of the front rod unit so as to come into contact with the spring bracket; and a rear rod unit that is formed by extending from the rotating center part to an opposite side, with a rear contact protrusion protruding on a surface of the rear rod unit so as to come into contact with a rear surface of the pedal arm.

2. The apparatus for reducing clutch pedal effort as set forth in claim 1, further comprising:

a turnover spring that is held by the spring bracket, with opposite ends of the turnover spring held by opposite side surfaces of the pedal member, respectively, such that, during the forward rotation of the pedal arm, the turnover spring provides elasticity in cooperation with the reaction providing unit so as to intensify the forward rotation of the pedal arm.

3. The apparatus for reducing clutch pedal effort as set forth in claim 1, wherein, to allow the reaction providing unit to set the initial position of the switching lever in a state in which the pedal arm is not worked, a joint at which the switching lever is combined with the reaction providing unit is placed ahead of a reference line that passes both a center of the pedal hinge and a joint at which the pedal member is combined with the reaction providing unit.

4. The apparatus for reducing clutch pedal effort as set forth in claim 1, wherein:

the front rod unit is provided with a guide protrusion that protrudes in a direction opposite to the front contact protrusion, and the pedal member is provided with a guide slot that is formed along a radius of rotation of the switching lever so as to guide a movement of the guide protrusion during the rotation of the switching lever.

5. The apparatus for reducing clutch pedal effort as set forth in claim 1, wherein a front bushing and a rear bushing are coupled with the front contact protrusion and the rear contact protrusion, respectively, and function to prevent generation of noise and to absorb shock when the front and rear contact protrusions come into contact with the spring bracket and the pedal arm, respectively.

6. The apparatus for reducing clutch pedal effort as set forth in claim 1, wherein the reaction providing unit comprises:

a rotating shaft rotatably installed by passing through opposite side surfaces of the pedal member;

a shaft holder, with a surface contact groove formed on a first end of the shaft holder so as to be supported by coming into surface contact with an outer circumferential surface of the rotating shaft, and with a guide pin extending from a second end of the shaft holder;

a lever holder, with a fork part formed on a first end of the lever holder and having a locking groove so as to be engaged with the locking protrusions of the switching lever, and with a holder rod extending from a second end of the lever holder and having a pin insert hole so as to receive the guide pin of the shaft holder therein;

a nut engaged with the holder rod; and a compression spring fitted over the holder rod in a state in which opposite ends of the compression spring are abutted by the shaft holder and by the nut, respectively.

7. The apparatus for reducing clutch pedal effort as set forth in claim 6, wherein:

external threads are formed around an outer circumferential surface of the holder rod in an axial direction of the holder rod, and the nut is engaged with the external threads of the holder rod such that the nut adjusts elasticity of the compression spring by moving along the axial direction of the holder rod.

* * * * *